US006305172B1

(12) United States Patent
Kim

(10) Patent No.: US 6,305,172 B1
(45) Date of Patent: Oct. 23, 2001

(54) SCROLL FOR A COMBUSTION SYSTEM

(75) Inventor: Myeong-hyo Kim, Changwon (KR)

(73) Assignee: Samsung Aerospace Industries, Ltd., Kyongsangnam-Do (KR)

( * ) Notice: Subject to any disclaimer, the term of this patent is extended or adjusted under 35 U.S.C. 154(b) by 0 days.

(21) Appl. No.: 09/498,992

(22) Filed: Feb. 7, 2000

(30) Foreign Application Priority Data

Feb. 8, 1999 (KR) ..... 99-4227

(51) Int. Cl.[7] ..... F02C 3/00
(52) U.S. Cl. ..... 60/760; 60/39.36
(58) Field of Search ..... 60/760, 758, 757, 60/752, 722, 39.36

(56) References Cited

U.S. PATENT DOCUMENTS 4,002,157 * 1/1977 Toesca ..... 60/39.36 X
4,339,925 * 7/1982 Eggmann et al. ..... 60/760 X
4,719,748 * 1/1988 Davis, Jr. et al. ..... 60/760 X
4,872,312 * 10/1989 Iizuka et al. ..... 60/760
5,305,608 * 4/1994 Loving ..... 60/752 X
6,101,806 * 8/2000 Chen et al. ..... 60/39.07

* cited by examiner

*Primary Examiner*—Charles G. Freay
*Assistant Examiner*—David J. Torrente
(74) *Attorney, Agent, or Firm*—Finnegan, Henderson, Farabow, Garrett & Dunner LLP

(57) ABSTRACT

A scroll for a gas turbine having a compressor for generating compressed air and a combustor for receiving the compressed air and generating combustion gas of high temperature, the scroll includes a scroll main body having a predetermined space in which the combustion gas of high temperature supplied by the combustor can flow; and a scroll housing encompassing the scroll main body and separated a predetermined distance therefrom, wherein a path through which compressed air flows is formed between the scroll main body and the scroll housing, and the compressed air flows in the path, wherein one end of the path is connected to an outlet of the compressor and the other end thereof is open toward the combustor. Thus, as the amount of air flowing to cool the scroll sharply increases, an increase in the temperature of the scroll is prevented and the efficiency of cooling and durability of the scroll can be improved. Also, as all the compressed air flowing in the combustor is used for cooling of the scroll, in advance, the temperature of the air in the combustor increases so that the efficiency of combustion can be improved.

10 Claims, 3 Drawing Sheets

SCROLL FOR A COMBUSTION SYSTEM

BACKGROUND OF THE INVENTION

1. Field of the Invention

The present invention relates to a scroll of a gas turbine, and more particularly, to a scroll of a gas turbine in which the structure of the air path for cooling the scroll is improved.

2. Description of the Related Art

As shown in FIG. 1, a typical gas turbine engine used as an engine for industrial use includes compressors 10*a* and 10*b* for compressing external air A multiple times, a combustor 13 inside a casing for generating gas of high temperature and high pressure in a liner 12 by injecting and igniting fuel through a nozzle 14 to compressed air supplied from an outlet 10*c* of the compressors 10*a* and 10*b,* and a turbine 16 for generating a rotation force using a high pressure gas generated from the combustor.

The gas generated from the combustor 13 is provided to rotate a wheel (not shown) of the turbine 16 having a plurality of blades. A scroll 20 is related to the design of a path which appropriately guides the flow of gas.

Referring to FIG. 2, the scroll 20 includes a scroll main body 21 connected to the combustor 13 via the liner 12 and forming an annular space 28, and guiding scrolls 25 and 26 connected to an opening at one side of the scroll main body 21 and extending toward the blade of the turbine 16, forming a nozzle 27 through which gas of high temperature and high pressure flowing in the annular space 28 is injected. As combustion gas of very high temperature flows in the scroll 20, a cooling structure to cool the scroll is needed. For this, scroll housings 22, 23 and 24 are installed outside the scroll main body 21 and the guiding scrolls 25 and 26, at a predetermined gap, and cooling air flows through the gap formed between the scroll housings 22, 23 and 24 and the scroll main body 21 and the guiding scrolls 25 and 26. As shown in FIG. 2, the cooling air flowing around the scroll 20 comes into the gap through holes formed in the scroll housings 22, 23 and 24 to cool the scroll 20.

The air supplied from the compressors 10*a* and 10*b* is mainly used as the cooling air needed in the above cooling method. Arrows shown in FIG. 1 indicate the flow of the air flowing to the gas turbine. When the external air A is compressed by the compressors 10*a* and 10*b* and comes out through the compressor outlet 10*c,* most of the air is supplied to the casing 11 and the combustor 13 through a path formed outside the liner 12 and burned with the fuel. The remaining portion of the air is used for cooling of the scroll 20 while flowing around the scroll 20.

Thus, in the scroll of the conventional gas turbine having the above structure, as only an extremely small portion of the compressed air is used for cooling, the efficiency of cooling is lowered so that an increase in temperature of the scroll is not appropriately prevented and thus durability of the scroll is lowered.

SUMMARY OF THE INVENTION

To solve the above problems, it is an objective of the present invention to provide a scroll of a gas turbine having a structure in which all of the compressed air is used for cooling the scroll so that the efficiency of cooling of the scroll is improved.

Accordingly, to achieve the above objective, there is provided a scroll for a gas turbine having a compressor for generating compressed air and a combustor for receiving the compressed air and generating combustion gas of high temperature, the scroll comprising a scroll main body having a predetermined space in which the gas of high temperature supplied by the combustor can flow, and a scroll housing encompassing the scroll main body and separated a predetermined distance therefrom, wherein a path through which compressed air flows is formed between the scroll main body and the scroll housing, and the compressed air flows in the path, wherein one end of the path is connected to an outlet of the compressor and the other end thereof is open toward the combustor.

Here, it is preferable in the present invention that the scroll housing is shaped to correspond to the scroll main body such that a cross sectional area of the path can be substantially constant.

It is preferable in the present invention that one end of the path is formed by the scroll housing and a guiding member connecting the compressor and the scroll main body.

It is preferable in the present invention that the cross sectional area of the path is substantially the same as that of the outlet of the compressor.

It is preferable in the present invention that the cross sectional area of the path is substantially the same as that of the outlet of the compressor.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

While the air coming out from an outlet of a compressor is of high pressure and high speed, the air coming into a combustor has a reduced speed because the combustor has a relatively larger space. To maximize the effect of cooling, a housing is installed outside a scroll to form a path so that the air of high pressure and high speed at the outlet of the compressor can directly cool the scroll. To prevent lowering of the compression effect and cooling effect due to reduction of speed of flow while passing through the path, the sectional area of the path must be constantly maintained.

Figure 1:
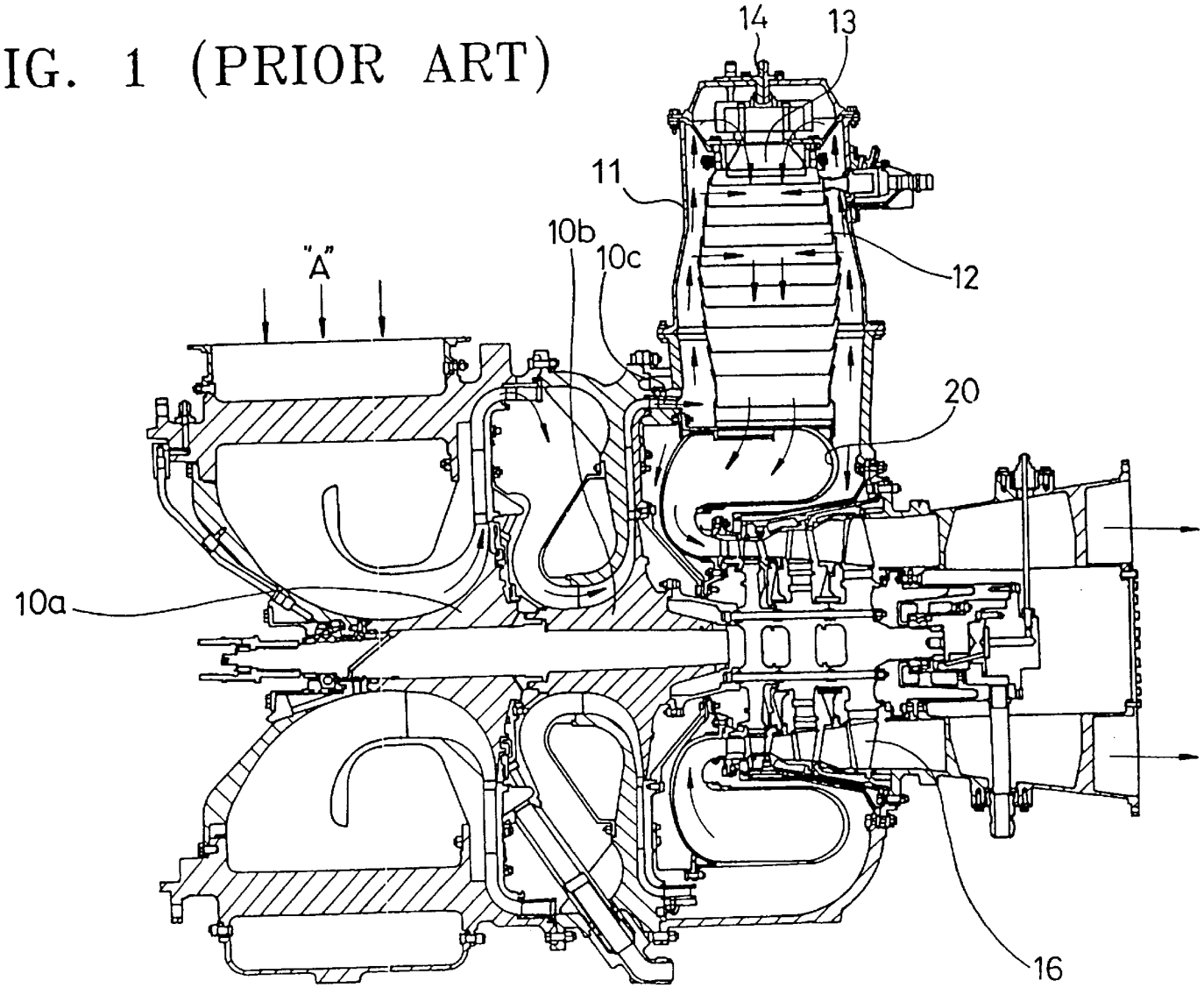
FIG. 1 (PRIOR ART)
FIG. 1 is a view showing the structure of a typical gas turbine, in which the flow of compressed air is shown.
Figure 2:
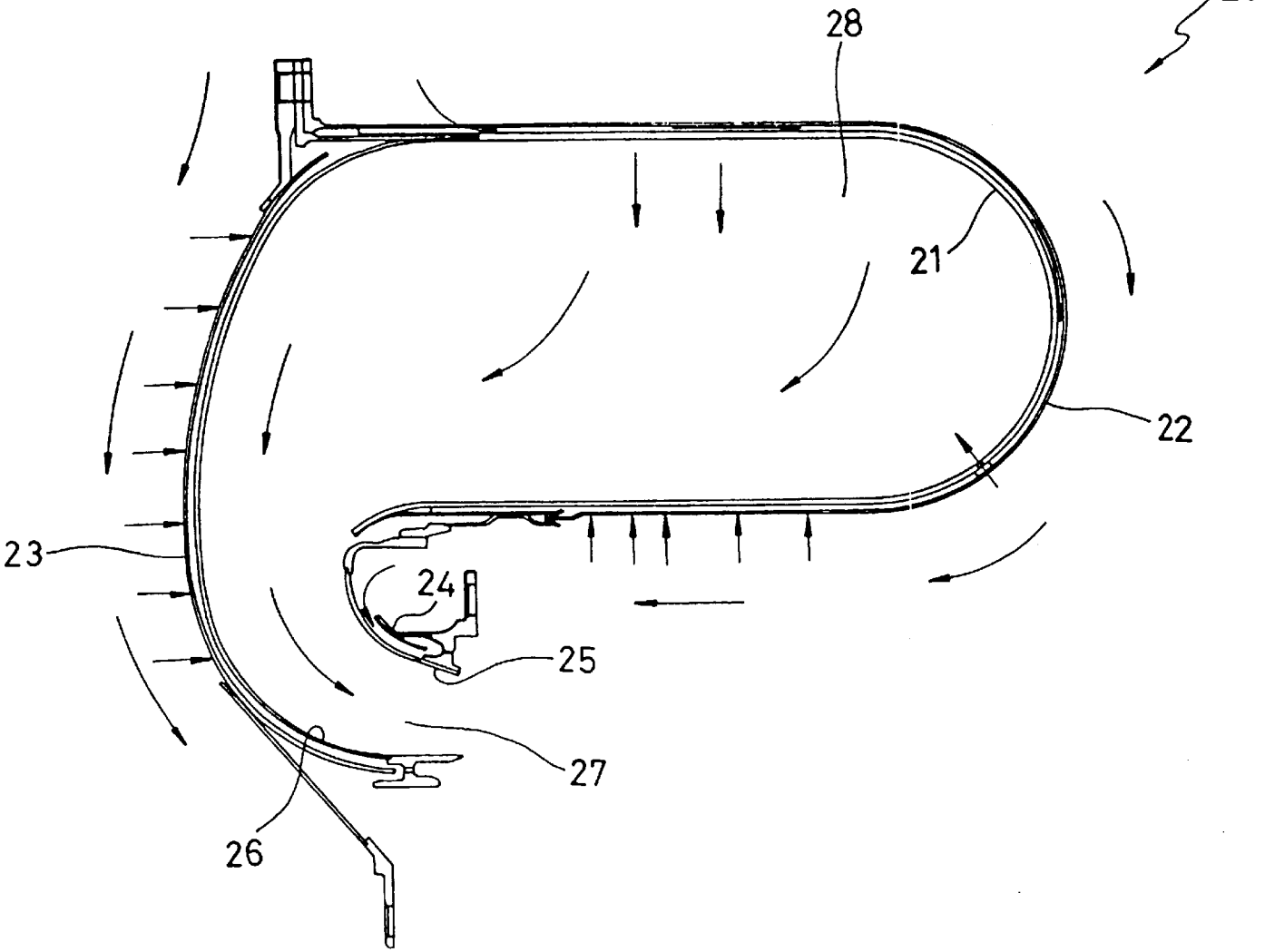
FIG. 2 (PRIOR ART)
FIG. 2 is a sectional view of the scroll of the gas turbine of FIG. 1.
Figure 3:
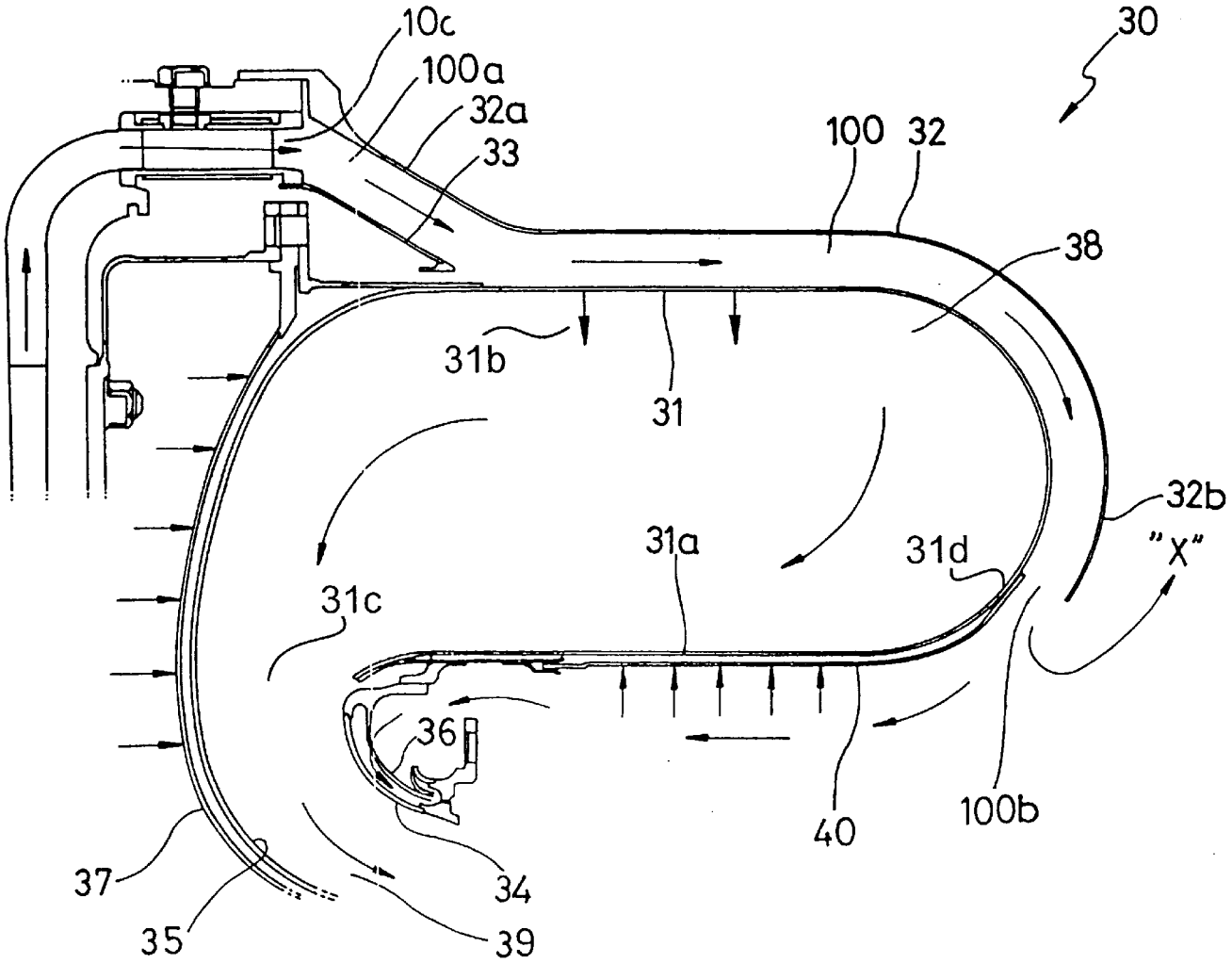
FIG. 3 is a sectional view of a scroll of the gas turbine according to the present invention.

Referring to FIG. 3, a scroll 30 of a gas turbine according to the present invention includes a scroll main body 31 formed in an annular shape and having an inner space 38 in which combustion gas of high temperature and high pressure flows, and a scroll housing 32 installed to encompass the scroll main body 31 by being separated a predetermined distance therefrom.

The scroll main body has an opening 31*b* formed at one side thereof connected to a combustor and another opening 31*c* at the other side thereof connected guiding scrolls 34 and 35. As the scroll housing 32 is shaped corresponding to the scroll main body 31 to be the same as or similar to the scroll main body 31, a path 100 having a predetermined cross sectional area can be formed between the scroll housing 32 and the scroll main body 31.

At an end 100*a* of the path 100 connected to the compressor outlet 10*c* of the gas turbine, one end 32*a* of the scroll housing 32 can be bent at a predetermined angle and connected to the outlet 10*c* and a guiding member 33 for connecting the outlet 10*c* and a predetermined portion of the scroll main body 31 and guiding the compressed air can be installed.

The other end 32*b* of the scroll housing 32 ends up at the predetermined portion of the scroll main body 31*d* to allow the air to flow toward the combustor (X) as the air passing through the path 100 which passes the compressor and becomes air of high pressure must be used for combustion. Thus, the other end 100*b* of the path 100 is open toward the combustor (X) of the gas turbine and the path 100 encompasses a part of the scroll main body 31. An auxiliary housing 40 for cooling is installed, to be separated a predetermined distance, at the other portion 31*a* alternatively referred to as a lower or guiding portion, of the scroll main body 31 where the path 100 is not formed. A predetermined gap is formed between the auxiliary housing 40 and the scroll main body 31. Part of the compressed air coming out from the outlet 100*b* of the path 100 flows in through holes (not shown) formed in the auxiliary housing 40 and flows to cool the other portion 31*a* of the scroll main body 31.

Thus, as indicated by the arrows, the compressed air coming out from the compressor outlet 10*c* all flows along the path 100. Preferably, to prevent lowering of the efficiency of compression and cooling at the compressor outlet 10*c*, the cross sectional area of the path 100 is substantially the same as that of the compressor outlet 10*c*. As a result, the outlet of the compressor extends to the end portion 100*b* of the path so that the air flowing through the path 100 can cool the scroll and simultaneously the temperature of air flow increases. Hence, the temperature of air supplied to the combustor increases to assist combustion and improve the efficiency of the engine.

Guiding scrolls 34 and 35 are installed at the opening of the other side of the scroll main body 31. The guiding scrolls 34 and 35 are extended toward the nozzle-vane of a turbine (not shown) and forms a nozzle 39 so that gas of high temperature and high pressure flowing into the annular space 38 can be injected.

Guiding scroll housings 36 and 37 are installed at a predetermined interval outside the guiding scrolls 34 and 35 so that air for cooling can flow through a gap formed therebetween. As shown in FIG. 3, part of the air coming out from the other end 100*b* of the path 100 flows into the gap through holes formed in the guiding scroll housings 36 and 37 and cools the guiding scrolls 34 and 35.

In the above scroll of the gas turbine, the compressed air coming out from the compressor outlet 10*c* all flows in the path 100 to cool the scroll main body 31 and most of the compressed air coming out from the outlet 100*b* of the path 100 flows toward the combustor (X). Part of the compressed air flows around the scroll 30 to cool the guiding scrolls 34 and 35.

Thus, in the scroll of the gas turbine according to the preferred embodiment of the present invention, as the amount of air flowing to cool the scroll sharply increases, an increase of temperature of the scroll is prevented and the efficiency of cooling and durability of the scroll can be improved. Also, as all the compressed air flowing in the combustor is used for cooling of the scroll, in advance, the temperature of the air flowing in the combustor increases so that the efficiency of combustion can be improved.

It is noted that the present invention is not limited to the preferred embodiment described above, and it is apparent that variations and modifications by those skilled in the art can be effected within the spirit and scope of the present invention defined in the appended claims.

What is claimed is:

1. A scroll for a combustion system having a compressor for supplying compressed air to a casing, a combustor arranged inside the casing for receiving the compressed air from the compressor and generating combustion gas, and a turbine arranged along substantially the same axis as the compressor for generating mechanical power based on the combustion gas generated by the combustor, the scroll comprising:

a scroll main body arranged inside the casing and having an upper opening for receiving combustion gas from the combustor, and a lower portion shaped to guide combustion gas toward a lower opening for directing combustion gas toward the turbine; and a scroll housing arranged between the casing and the scroll main body so as to guide compressed air received from the compressor along a path having a substantially uniform cross-sectional area, and encompassing a portion of the scroll main body extending between a first end connected to an outlet of the compressor and a second end open toward the lower portion of the scroll main body and the combustor such that the compressed air received from the compressor is directed toward the lower portion of the scroll and into the combustor.

2. The scroll of claim 1, wherein the scroll housing extends from a first side of the outlet of the compressor, and the scroll housing further includes a guiding member extending from a second side of the outlet of the compressor.

3. The scroll of claim 2, wherein the guiding member extends substantially parallel to the scroll housing.

4. The scroll of claim 1, wherein the cross sectional area of the path defined by the scroll housing is substantially the same as the outlet of the compressor.

5. The scroll of claim 1, wherein the scroll main body includes a substantially curvilinear portion connected to the lower portion.

6. The scroll of claim 1, further comprising an auxiliary housing encompassing this lower portion of the scroll main body and configured to permit compressed air received from the second end of the path defined by the scroll housing to cool the lower portion of the scroll main body.

7. The scroll of claim 6, wherein the auxiliary housing extends substantially parallel to the lower portion of the scroll main body and is separated from the lower portion by a predetermined distance.

8. A scroll for a combustion system having a compressor for supplying compressed air to a casing, a combustor arranged inside the casing for receiving the compressed air from the compressor and generating combustion gas, and a turbine arranged along substantially the same axis as the compressor for generating mechanical power based on the combustion gas generated by the combustor, the scroll comprising:

a scroll main body arranged inside the casing and having an upper opening for receiving combustion gas from the combustor, and a lower portion shaped to guide combustion gas toward a lower opening for directing combustion gas toward the turbine;

a scroll housing arranged between the casing and the scroll main body so as to guide compressed air received from the compressor along a path having a substantially uniform cross-sectional area, and encompassing a portion of the scroll main body extending between a first end connected to an outlet of the compressor and a second end directed toward the lower portion of the scroll main body; and wherein the scroll main body includes at least one guiding scroll extending from the lower opening so as to define a nozzle for directing the combustion gas toward the turbine, and further comprising at least one guiding scroll housing configured to direct compressed air received from the second end of the path defined by the scroll housing toward the at least one guiding scroll of the scroll main body.

9. The scroll of claim 8, wherein the at least one guiding scroll housing extends substantially parallel to the at least one guiding scroll of the scroll main body.

10. The scroll claim 8, wherein the second end of path defined by the scroll housing is configured to direct compressed air received from the outlet of the compressor toward the at least one guiding scroll of the scroll main body.

* * * * *

UNITED STATES PATENT AND TRADEMARK OFFICE

CERTIFICATE OF CORRECTION

PATENT NO. : 6,305,172 B1
DATED : October 23, 2001
INVENTOR(S) : Myeong-hyo Kim

It is certified that error appears in the above-identified patent and that said Letters Patent is hereby corrected as shown below:

Column 4,
Line 43, “this lower”, should read -- the lower --.

Signed and Sealed this

Twenty-sixth Day of November, 2002

*Attest:*

*Attesting Officer*

JAMES E. ROGAN
*Director of the United States Patent and Trademark Office*